United States Patent [19]

Koziol et al.

[11] 4,098,504

[45] Jul. 4, 1978

[54] TENNIS BALL

[75] Inventors: Dale Lee Koziol, Marion, Ind.; Thomas Freeman Reed, Akron, Ohio

[73] Assignee: The General Tire & Rubber Company, Akron, Ohio

[21] Appl. No.: 627,721

[22] Filed: Oct. 31, 1975

[51] Int. Cl.[2] ..... A63B 41/00

[52] U.S. Cl. ..... 273/61 R; 273/65 ED; 273/DIG. 20

[58] Field of Search ..... 273/61, DIG. 20, 58 B, 273/58 BA, 65 ED, 65 B, 65 EE, 65 E; 152/330

[56] References Cited

U.S. PATENT DOCUMENTS

| | | | |
|---|---|---|---|
| 2,012,283 | 8/1935 | Miller | 273/61 D |
| 3,047,040 | 7/1962 | Gross | 152/330 |
| 3,819,040 | 6/1974 | Coons | 273/61 D |

FOREIGN PATENT DOCUMENTS

| | | | |
|---|---|---|---|
| 2,402,418 | 7/1974 | Fed. Rep. of Germany | 273/61 D |
| 8,777 | 9/1974 | South Africa | 273/61 R |

OTHER PUBLICATIONS

"Flow of Gases through Polyethylene" Journal of Polymer Science, vol. L, 1961, pp. 413–439.

*Primary Examiner*—George J. Marlo

[57] ABSTRACT

A pressurized game ball including an air-permeable elastomeric wall defining a cavity containing a compressible inflation gas with the improvement being that the inflation gas includes predetermined mixed amounts of air and sulfur hexafluoride ($SF_6$) gas which effectively enables the ball to retain its pressurized state within a desired range of pressures for a period of time significantly longer than the ball would remain pressurized if the inflation gas were air alone.

1 Claim, No Drawings

TENNIS BALL

BACKGROUND OF THE INVENTION

The present invention generally relates to pressurized game balls and more particularly to an improved tennis ball having an air-permeable elastomeric wall defining a fluid pressurized cavity, or the like. The invention has been found especially useful and successful when embodied as an improved tennis ball and will herein be described as such.

DESCRIPTION OF THE PRIOR ART

Conventionally, the cavities of rubber articles such as tennis balls have been inflated with air, such as from a standard factory air line, although it is also known to use other inflating substances such as nitrogen, ammonia, and the like. However, air has been by far the most commonly used substance because of its ease of use for inflation, its negligible cost and its availability. Although a tennis ball inflated with air initially has satisfactory playability, it is unable to retain its rebound and playability unless it is kept in a pressurized atmosphere when not in use, since the air permeates the rubber wall or core of the ball and gradually escapes.

The invariable loss of the internal air pressure in game balls having no valve for re-inflation, such as tennis balls, presently makes it necessary, or at least very desirable, to package air-inflated tennis balls in a pressurized container as soon as they are manufactured, since their "shelf-life" outside of a pressurized package is relatively short, i.e., the ball's internal pressure falls below the minimum pressure required for satisfactory performance. The use of pressurized containers is an additional expense incidental to manufacturing and marketing the balls.

Pertinent prior publications where inflatable articles are pressurized with gases of large molecular size includes the following:

U.S. Pat. No. 3,047,040 discloses the use of several gases for inflating tires and the like to impart a smoother ride to the vehicle which are described as gases having a "low gamma" of less than about 1.25 which relates exclusively to compressibility and not to permeability. The gases listed include $SF_6$ among several other gases as being a "low gamma" gas. Union of South Africa No. 73/8777, published Jan. 18, 1973, discloses the use of perfluoropropane gas ($C_3F_8$) and DuPont Freon F-114 ($Cl_2CFCF_3$) to inflate game balls for prolonged pressure retention. In experimental work with the present invention, F-114 was found to be unsuitable and $C_3F_8$, though being somewhat more suitable, is a relatively rare and expensive gas without sufficient commercial demand to bring its price and availability into commercial consideration as an inflating medium. As will later become apparent, $SF_6$ was found to be substantially more suitable in terms of extended pressure retention, material cost and ready availability. U.S. Pat. No. 2,997,291 discloses an auto type hydraulic shock absorber using a hudraulic volume compensator of special low permeability film such as nylon inflated with DuPont Freons as a foam eliminator. U.S. Pat. No. 2,779,066 discloses thermal insulation members such as fiberglass enclosed with a laminated gas impermeable film such as "Mylar" and "Saran" and filled with a thermally low conductive gas such as DuPont F-12. F-12 was found to be unsuitable for retaining pressure in game balls.

SUMMARY OF THE INVENTION

It is an object of the present invention to provide an inflating medium as a component for pressurized articles such as tennis balls which will not permeate the elastomeric cavity wall as readily as air.

It is a further object of the present invention to provide a pressurized article of manufacture such as an inflated tennis ball which will maintain the internal gas pressure required for good service for a substantially extended period of time.

It is also an object of the present invention to provide an inflating medium for tennis balls which will make it possible to package and store the balls in other than pressurized containers for extended periods prior to use.

The foregoing and other objects of the present invention are attained in a pressurized article of manufacture including an air-permeable elastomeric wall defining a hollow cavity containing a compressible inflation gas with the improvement being that the inflation gas includes a predetermined amount of air and a predetermined amount of sulfur hexafluoride gas which is effective to enable the cavity to retain its pressurized state within a desired range of pressures for a period of time lasting significantly longer than the cavity would remain pressurized if the inflation gas were air alone. Such pressurized article may be embodied as a game ball such as a tennis ball.

If air is included in the ball with approximately atmospheric partial pressure and the $SF_6$ is the remaining partial pressure, the longer lasting pressure lifetime is solely the result of slow loss of the $SF_6$ gas to atmospheric pressure.

However, there is an additional useful and advantageous characteristic of a ball inflated with sulfur hexafluoride or other low permeability gas. When air is included in the ball, its partial pressure as part of the total pressure can be provided at less than atmospheric pressure. Under these conditions, the total pressure inside the ball tends to slowly increase from the permeation of air into the ball concurrently with a slow decrease of the total pressure due to the loss of the $SF_6$ out of the ball.

The initial pressure for the air component is that which would maintain the internal pressure of the air/$SF_6$ system within the acceptable range for the longest period of time. This dual mechanism of the present invention is capable of extending the useful playing lifetime of an inflated ball even further. Furthermore, the extent of the pressure increase from the permeation of air into articles inflated according to the present disclosure (and hence the useful lifetime) can be controlled within limits by the relative concentrations of air and low permeability gas used to pressurize the articles.

The $SF_6$, as used with air in the present invention, is inexpensive, readily available and superior as a low permeability gas for maintaining sufficient playing pressure in a game ball over a substantially extended playing period as compared to air pressurized balls.

DESCRIPTION OF A PREFERRED EMBODIMENT

The subject invention is applicable to a game ball having a resilient elastomeric wall defining a hollow cavity which is pressurized and maintained in a pressurized condition with a compressible fluid or gas. The present invention is especially useful in tennis balls wherein the elastomeric wall or core of the ball is made from natural rubber or equivalent elastomeric compounds known in the tennis ball art.

A tennis ball consists essentially of a hollow rubber core covered with a cloth, usually a felt, composed of wool and nylon. The International Lawn Tennis Federation requires that the following specification be met at a temperature of 20° C and a relative humidity of 60%:

1. Diameter ('go-no-go' gauges), 2.575–2.700 in. (65.4-68.6mm)
2. Weight, 22 1/16 oz. (56.70-58.47g).
3. Rebound from 100 in. (2.54m) on to concrete, 53–58 in. (1.35–1.47m).
4. (a) Deformation under 18 lbf (8.2 kgf) load, 0.230–0.290 in. (5.85–7.35mm).
   (b) Deformation under 18 lbf (8.2 kgf) load on recovery after ball has been compressed through 1 in. (25.4mm), 0.355–0.425 in. (9–10.8mm).

The test in 4(a) measures the 'compression' or 'hardness' property of the ball, and that in 4(b) measures hysteresis after the ball has been compressed through 1 in. (25.4mm). The tests are carried out on a special 'Stevens' machine. (British Pat. No. 230,250).

The core halves of a conventional pressure type tennis ball, which is fabricated together and inflated during fabrication to an internal air pressure of about 17 psi (117 kPa) gauge or about 32 psi absolute (220 kPa absolute), will generally have satisfactory rebound as long as a minimum pressure of about 13 to 15 psi (89.7–103 kPa) gauge or 28 to 30 psia (192–203 kPa absolute) is maintained.

It has been discovered that sulfur hexafluoride ($SF_6$) as a low permeability gas mixed with proper proportions of air achieve the objective of providing an inflation medium which is retained by the elastomeric walls within the cavity at acceptable pressures over a substantially greater extended period. Such a gas needs characteristics as follows:

1. The molecules of the gas are sufficiently large and chemically appropriate to deter their permeation through such elastomeric walls either through solubility or diffusion;
2. The vapor pressure of the gas with a proper amount of air is adequate to maintain desired operating pressures within the ball through the ordinary range of temperatures in which the article is used; and
3. The flammability and toxicity properties of the gas are sufficiently low so that no hazards exist either in manufacturing or in consumer use.

The following is an example of tests of tennis balls utilizing sulfur hexafluoride ($SF_6$) gas.

Two pairs of tennis ball cores were prepared without the felt covering; the first pair was inflated with normal laboratory air and the second pair was pressurized from ambient to final pressure with air at ambient pressure plus sulfur hexafluoride gas. All of the cores had 103 kPa (15 psi) gauge or (30 psia) pressure when they were initially inflated. From the partial pressures of air and sulfur hexafluoride gas in the balls containing sulfur hexafluoride, the concentration of sulfur hexafluoride was 50.5 volume percent.

The two responses used to monitor pressure changes inside the cores were deflection under 80 N (18 lbs.) load and percent rebound from a granite surface. As gas is lost from the balls and pressure decreases, their deflections increase and their rebound values decrease. To aid in comparison, all values of deflection were divided by the measurements made on the zeroth day, i.e. normalized. The left hand column for each gas indicates the number of days of aging at room temperature and pressure which had elapsed between production and the listed rebound and deflection readings. The deflection and rebound results are the averages from duplicate cores.

TABLE I

| AIR | | | $SF_6$ | | |
|---|---|---|---|---|---|
| Days | Rebound | Deflection | Days | Rebound | Deflection |
| 0 | 1.000 | 1.000 | 0 | 1.000 | 1.000 |
| 10 | 0.994 | 1.003 | 8 | 0.985 | 0.988 |
| 17 | 0.963 | 1.012 | 15 | 0.984 | 0.964 |
| 24 | 0.960 | 1.006 | 22 | 0.984 | 0.955 |
| 31 | 0.949 | 1.061 | 29 | 0.978 | 0.994 |
| 52 | 0.959 | 1.052 | 50 | 0.982 | 0.973 |
| 236 | 0.894 | 1.231 | 234 | 0.980 | 1.067 |

The date clearly show that the cores containing the sulfur hexafluoride retained their rebound and deflection properties much longer which is a direct result of longer gas retention. The data are for comparison and are only proportional to tennis association standards for completed tennis balls.

Since the pressure differential ($\Delta P$) of the low permeability gas and of the air influences the permeation of the respective gases through the elastomeric wall of a game ball, said pressure differential affects the continuing pressure and pressure variation within the ball.

If the partial pressure of the air within the ball is below atmospheric and the remaining partial pressure is that of a low permeability gas such as $SF_6$, the total pressure in the ball will initially increase until the air partial pressure in the ball is equal to that of the air outside the ball. Such pressure increase occurs because air permeates into the ball at a somewhat greater rate than the rate at which the low permeability gas permeates out of the ball. As the air differential pressure across the wall of the ball approaches zero, then any further change in pressure of the ball will be due to the slow permeation of the $SF_6$ out through the wall of the ball.

For example, a tennis ball can be inflated with air and $SF_6$ to a pressure of 30 psia (203 kPa absolute) with the partial pressure of the air being about 12 psia (82 kPa absolute) and the partial pressure of the $SF_6$ being about 18 psia (124 kPa absolute). Additional air will permeate into the ball and the $SF_6$ will gradually and more slowly permeate out of the ball. The total pressure within the ball will gradually increase to between about 32 (220 kPa absolute) and 33 psia (227 kPa absolute) (17–18 psia) until the air pressure equalizes while the $SF_6$ slowly begins to decline. Thereafter the total pressure will continue to slowly decline due solely to the very slow permeation of the $SF_6$ through the wall of the ball. The ball will remain playable (unless the felt is first worn off) until the total pressure declines to about 28 psia (13 psig) (192 kPa absolute), corresponding to the proper rebound range for conventional tennis balls pressurized with air alone.

As seen from Table 1 above, the balls inflated with the air/$SF_6$ system had negligible pressure decline after 234 days (about 9½ months). Conceivably, and projecting Table 1, the balls with the air/$SF_6$ system of Table 1 can have a shelf life of many months without a pressurized package and thereafter last in playable condition for many more months before the total pressure in and, hence the rebound of, the ball declines below a playable level.

Further, a ball manufactured with partial pressure of the air below atmospheric, as in the above example, would retain a playable pressure for yet additional months.

As a second example, a tennis ball could be inflated to 15 psig (103 kPa) with pure $SF_6$. Thereafter, air would permeate into the ball until the air partial pressure in the ball equals atmospheric pressure, resulting in an undesirable playing pressure initially approaching 30 psig (203 kPa).

Experiments have not as yet been made to substitute the principal respective components of air, oxygen ($O_2$) and nitrogen ($N_2$), to establish whether or not either $Q_2$ or $N_2$ could be used respectively in lieu of air to provide a partial pressure in a game ball along with an additional appropriate partial pressure of $SF_6$. However, it is considered that these gases and other gases having permeability rates no greater than air can be used.

The foregoing description will suggest other embodiments and variations to those skilled in the art, all of which are intended to be included in the spirit of the invention as herein set forth.

We claim:

1. A tennis ball having improved pressure retention properties comprising an elastomeric gas-permeable wall defining a hollow cavity containing a compressible inflation gas under pressure, said inflation gas including:
   (a) air having a partial pressure equal to ambient pressure; and
   (b) sulfur hexafluoride in an amount sufficient to significantly improve the pressure retention properties of said ball as compared to the pressure retention properties of said ball when filled with air.

* * * * *